US008322400B2

(12) United States Patent
Benedetti

(10) Patent No.: US 8,322,400 B2
(45) Date of Patent: Dec. 4, 2012

(54) CASTING AND CONTINUOUS ROLLING METHOD AND PLANT TO MAKE LONG METAL ROLLED PRODUCTS

(75) Inventor: Gianpietro Benedetti, Tricesimo (IT)

(73) Assignee: Danieli & C. Officine Meccaniche SpA, Buttrio (IT)

( * ) Notice: Subject to any disclaimer, the term of this patent is extended or adjusted under 35 U.S.C. 154(b) by 133 days.

(21) Appl. No.: 12/858,772

(22) Filed: Aug. 18, 2010

(65) Prior Publication Data

US 2011/0315340 A1 Dec. 29, 2011

(30) Foreign Application Priority Data

Jun. 24, 2010 (IT) ..... UD2010A0125

(51) Int. Cl.
*B22D 11/12* (2006.01)
*B22D 11/126* (2006.01)
*B21B 1/46* (2006.01)

(52) U.S. Cl. ..... 164/460; 164/471; 164/476; 164/263; 164/417; 29/527.7

(58) Field of Classification Search ..... 164/460, 164/476, 477, 417, 263, 269, 424, 471, 493, 164/507; 29/33 C, 527.7
See application file for complete search history.

(56) References Cited

U.S. PATENT DOCUMENTS 6,240,763 B1 * 6/2001 Benedetti ..... 72/239
2012/0018114 A1 * 1/2012 Benedetti ..... 164/460

FOREIGN PATENT DOCUMENTS

EP 0625383 11/1994
EP 0919296 6/1999

* cited by examiner

*Primary Examiner* — Kevin P Kerns
(74) *Attorney, Agent, or Firm* — Hamre, Schumann, Mueller & Larson, P.C.

(57) ABSTRACT

A method for making long metal rolled products by continuous casting at high hourly productivity, by a single casting machine, a product with a rectangular section; shearing to size of the cast product to define a segment of a length between 16 and 150 m and a weight between 10 and 100 tons; introduction of the segment, having an average temperature of at least 1000° C., into a maintenance and/or possible heating furnace having a first section for moving the cast product disposed in axis with the casting axis; lateral transfer of the segment inside the furnace to transfer the segment to a second section for moving the cast product disposed parallel and misaligned with respect to the first section and aligned with a rolling axis parallel and offset with respect to the casting axis; and reduction of the section in a rolling mill.

7 Claims, 6 Drawing Sheets

| | | SEMI-ENDLESS | |
|---|---|---|---|
| Nominal sizes bloom section | mm | 160x280 | 150x150 |
| Casting speed | m/min | 5.7 | 2.8 |
| N° of casting lines | | 1 | 4 |
| Hourly productivity | t/ora | 120 | 120 |
| Annual productivity | t/anno | 800000 | 800000 |
| Metric weight of bloom | t/m | 0.352 | 0.177 |
| Bloom lenght | m | 60 (optimized) | 14 |
| Total bloom weight | t | 21.1 | 2.5 |
| | | | |
| Time lost due to head blockages | h | 39 | 326 |
| Loss of efficiency % | % | 0.50% | 4.30% |
| | | | |
| Total loss of material due to blockages in the train | t | 271 | 1.631 |
| Total loss of material due to blockages in the train | % | 0.03% | 0.20% |
| | | | |
| Total loss of material due to cropping in train and finishing and to short bars (endless 0.4%) | % | 0.60% | 1.70% |
| | | | |
| Scale in the maintenance/heating furnace | % | 0.20% | 0.80% |
| Total yield (furnace+train+finishing) | % | 99.17% | 97.30% |
| Buffer time maintenance/heating furnace | min | 45 | 0 |
| | | | |
| Consumption of natural gas in furnace | $Nm^3/h$ | 900 | 1800 |
| | $Nm^3/t$ | 7.5 | 15 |
| Consumption of natural gas in furnace compared to traditional solution | % | 50% | 100% |

| | | |
|---|---|---|
| NB: production time considered net of programmed maintenance | h | 7577 |

fig. 6

CASTING AND CONTINUOUS ROLLING METHOD AND PLANT TO MAKE LONG METAL ROLLED PRODUCTS

FIELD OF THE INVENTION

The present invention concerns a method and a casting and continuous rolling plant in semi-endless mode to make long metal rolled products such as bars, wire rod, beams, rails or sections in general, starting from material cast continuously at high speed and high productivity.

BACKGROUND OF THE INVENTION

Continuous casting plants, single line, known in the state of the art for the production of long rolled products have considerable limitations in that, for reasons intrinsically connected to operating constraints and performance of the components, their productivity does not generally exceed 25-40 ton/h. Consequently, in order to obtain higher productivity it is necessary to increase the number of casting lines connected to the same rolling line, which can be up to 8 lines or more. This entails, among other things, the need to translate the billets or blooms exiting from the various casting lines on a single entrance point of the heating furnace, with the consequent losses of temperature in the transfers.

The consequence of this is the considerable quantity of energy needed to feed the heating furnace, which has to restore the temperature lost and bring it from the entrance value, comprised between 650° C. and 750° C., to the value suitable for rolling, which is equal to about 1100° C.

Moreover, the need to transfer the segments of billets or blooms from the various casting lines to the point where they are introduced into the furnace, imposes limitations on the length and therefore the weight: the length of the billets or blooms is comprised between 12 and 14 m, up to a maximum of 16 m, and the weight is on average equal to 2-3 tons.

These process necessities and limitations are the main cause of an increase in energy required for heating the billets or blooms, and of a worsening of the full capacity, due both to the large-sized tundishes that are needed to serve several casting lines and also to the large number of billets or blooms to be processed given the same number of tons/hour to be produced, with consequent high number of crops, heads entering in the stands of the mill and sub-lengths with non-commercial sizes.

One purpose of the present invention is therefore to achieve a casting and continuous rolling process in semi-endless mode (that is, starting from segments of cast products sheared to size) for long products, and perfect a relative production plant which, using only one casting line, allows to increase productivity compared to similar plants in the state of the art.

Another purpose of the present invention is to exploit to the utmost the enthalpy possessed by the original liquid steel along all the production line, reducing temperature losses in the time between shearing the cast product to size and sending it to the rolling step, so as to obtain a considerable saving of energy and a reduction in the running costs compared to conventional processes.

A further purpose of the present invention is to deal with the stoppages of the rolling mill without having to interrupt the casting and therefore without loss of production and without penalizing the steel plant upstream.

Another purpose of the invention is to reduce to a minimum or eliminate the scrap material in emergency situations or during programmed stoppages and so completely recover the product which in these situations is temporarily accumulated in an intermediate point along the production line.

Further purposes of the invention are:

to reduce investment costs thanks to the reduction in the number of casting lines given the same production;

to guarantee a higher yield, equal to the ratio between weight of the finished product and weight of the liquid steel to produce a ton, to reduce the risks of cobbles during the rolling thanks to the reduction in the number of heads entering in the stands;

to obtain a greater stability of the rolling mill and a better dimensional quality of the finished product;

to bring the performance of a semi-endless process much closer to that of an endless process, that is, without solution of continuity between the continuous casting machine and the rolling unit;

to guarantee the possibility of changes in production in dimension and type without stopping the continuous casting, obtaining a higher plant utilization factor.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

A casting and continuous rolling plant of the semi-endless type for the production of long rolled products according to the present invention comprises a single continuous casting machine, with a crystallizer suitable to cast liquid steel at high speed and high productivity (for example, and only indicatively, from 35 up to 200 ton/h).

By high speed casting we mean that the continuous casting machine can cast products, in relation to thickness, at a speed variable from 3 to 9 m/min.

Advantageously, the crystallizer produces a substantially rectangular section, or in any case with a widened shape, that is, with one size prevailing over the other, hereafter defined in general as bloom.

In the description and in the claims, by the term bloom we mean a product with a rectangular section in which the ratio between the long side and the short side is comprised between 1.02 and 4, that is, just higher than the square section up to a rectangular section in which the long side is 4 times that of the short side.

In the present invention the section of the cast product is not limited to a quadrangular section with straight and two by two parallel sides, but also comprises sections with at least a curved, concave or convex side, advantageously but not necessarily two by two opposite and specular, or combinations of the aforesaid geometries.

A rectangular section has a greater surface than a square section having the same height, so that casting this type of section we obtain, given the same casting speed, a greater quantity in tons of material in the unit of time.

In accordance with the present invention, the cast section of a substantially rectangular form has a surface equal to that of a square with equivalent sides comprised between 100 and 300 mm.

Merely to give an example, the blooms which are produced by the continuous casting according to the present invention have dimensions varying between about 100 mm×140 mm, 100 mm×160 mm, 130 mm×180 mm, 130 mm×210 mm, 140 mm×190 mm, 160 mm×210 mm, 160 mm×280 mm, 180 mm×300 mm, 200 mm×320 mm or intermediate dimensions. In the case of the production of average profiles even bigger dimensional sections can be used, for example about 300 mm×400 mm and similar.

The casting machine according to the present invention therefore allows to reduce the number of casting lines needed for a plant to only one, given the same productivity, thus allowing to obtain a better yield, or full capacity, thanks to the fact that it is possible to use a smaller tundish, with less refractory consumption.

The rolling line also comprises, downstream from the continuous casting, shearing means suitable to cut the blooms to size into segments of a desired length. By desired lengths of the segments we mean a value comprised between 16 and 150 meters, preferably between 16 and 80 meters, more preferably between 40 and 60 meters. The optimum measurement of the segment is identified on each occasion on the basis of the type of product and the process modes, in the manner indicated hereafter in greater detail.

A maintenance and/or possible heating unit is located downstream from the casting machine, in which said segments, sheared to size, enter directly at an average temperature of at least 1000° C., preferably comprised between about 1100° C. and about 1150° C. The average temperature at which the bloom exits from the furnace is comprised between about 1050° C. and 1180° C.

In some embodiments, not restrictive for the scope of the invention, at exit from the maintenance and/or possible heating furnace, or in any case downstream of it, there is an inductor which has the function of bringing the temperature of the bloom segments to values suitable for rolling, at least when the temperature at which they exit from the furnace is about 1050° C. or lower.

The inductor can be present, or also present, in an intermediate position between the stands of the rolling mill.

According to a characteristic feature of the present invention, the axes of the casting machine and of the rolling mill are offset and parallel with respect to each other, which is why this configuration is suitable to make a semi-endless type process.

According to another characteristic feature of the invention, the maintenance and/or possible heating unit consists of a lateral transfer furnace which connects the casting line, located on a first axis, with the rolling line, located on a second axis, which as we said is offset and parallel to the first. The lateral transfer furnace is configured so as to compensate the different productivities of the continuous casting machine and the rolling mill.

The lateral transfer furnace has a length which can vary at least from 16 and 150 meters, preferably from 16 to 80 meters, in the specific case, but, according to a further characteristic feature of the present invention, the length is determined on each occasion in order to optimize the characteristics of the process, as will be explained in more detail hereafter.

In particular the length of the furnace is a determining planning parameter in sizing the line, in that it is the parameter which allows to identify the optimum compromise between productivity, energy saving, accumulation capacity, bulk, and more, as will be seen hereafter in the description.

In a preferential form of the invention, the lateral transfer furnace is subdivided into two sections, a first entrance section, aligned to the axis of the casting machine, which operates at the rhythm of the continuous casting, which allows to continuously introduce segments of bloom produced continuously by the casting, and a second exit section, aligned to the axis of the rolling mill, which operates at the rhythm of the rolling mill located downstream, so as to feed the segments of bloom to the rolling mill downstream without solution of continuity.

In this way, when the plant is working under normal conditions, the continuous casting and the rolling can operate in a substantially continuous condition, approaching an "endless" mode condition, even though they are working with segments sheared to size and with a rolling line misaligned with respect to the continuous casting machine.

The lateral transfer furnace also acts as an accumulation store for the blooms, for example when it is necessary to overcome an interruption in the rolling process, due to accidents or for a programmed roll-change or for change of production, in this way avoiding any losses of material and energy and, above all, avoiding any interruption of the casting. The furnace allows to obtain a buffer time of up to 60/80 minutes (at maximum casting speed) and more, and is in any case variable during the design of the plant.

This allows to considerably improve the plant utilization factor.

Thanks to the buffer capacity of the furnace, the overall yield is also improved for the following reasons:

the number of casting re-starts is reduced or eliminated, with consequent saving of waste material at start and end of casting;

steel which at the moment of an accidental blockage in the rolling mill, for example due to a cobble, is to be found from the tundish (which unloads the liquid steel into the crystallizer) at the beginning of the rolling mill does not have to be scrapped, nor the steel remaining in the ladle, which often cannot be recovered;

in the event of an accidental blockage of the rolling mill, the bloom already gripped in one or more stands can be returned inside the furnace and kept there, also at temperature, preventing any segmentation and therefore any loss of material.

According to one formulation of the present invention, the optimum length of the bloom, and hence of the lateral transfer furnace that has to contain it, is chosen as a function of the reduction to a minimum of the linear combination of the heat losses in said furnace and the losses of material due to crops, short bars and cobbles.

According to one example of calculation, the function is expressed according to the following formula:

$$F(E,Y)=ke\cdot E+ky\cdot Y;$$

where the term ke·E represents the economic loss caused by the energy consumption for maintaining and/or possibly heating the blooms, directly proportional to the length Lb of the bloom, while the term ky·Y represents the economic loss caused by crops, cobbles and short bars in the rolling mill, inversely proportional to Lb.

Therefore, expressing the same as a function of only one variable, for example the length of the bloom to be processed, and identifying the minimum point of said function, the optimum length of the bloom is found. The lateral transfer furnace will have an optimum length at least equal to that of the bloom; advantageously an adequate safety margin is provided which takes into account possible blooms sheared out of tolerance, and also the necessary dimensional and constructional adaptations.

In this way, the optimum operating conditions for the coordination of the continuous casting machine and the rolling mill are identified.

In one form of embodiment, not restrictive, the plant comprises an additional reduction unit, consisting of at least a rolling stand, and is provided so as to return the wide cast section to a square, round or oval shape, or in any case less wide than the starting section, so that it is suitable to feed the rolling mill.

The additional unit is provided immediately downstream of the continuous casting machine, when the speed of entrance into the first rolling stand is comprised between about 0.05 m/sec (or less) and about 0.08 m/sec. Since the reduction occurs on material that has just been cast, with a hot core, there are considerable advantages in terms of energy saving.

On the contrary, if the speed at entrance to the first stand is comprised between about 0.08 m/sec and about 0.1 m/sec (or higher), the unit is provided downstream of the lateral transfer furnace and therefore at the head of the rolling unit.

The present invention also concerns a rolling process for the production of long products, comprising a continuous casting step of blooms, a step of temperature maintenance and/or possible heating, and a rolling step, after the temperature maintenance and/or possible heating step, for the production of long rolled products.

According to a characteristic feature of the present invention, the temperature maintenance and/or possible heating step provides to keep a plurality of segments of blooms, sheared to size, in a condition of lateral transfer inside a furnace, for a time correlated to the size in length and width of the furnace, and determined so as to optimize the operating connection between continuous casting and rolling. The process thus provides to define an accumulation store between casting and rolling where the blooms can remain: the buffer time, which can be determined during the planning stage and can vary from 30 to 60/80 minutes or more, at maximum casting speed, is calculated in relation to the operating conditions of the plant and/or the maximum number of blooms that can be accumulated inside the furnace, in relation also to the section and length of the bloom.

In other forms of embodiment, the line according to the present invention comprises a first de-scaling device upstream of the lateral transfer furnace and/or a second de-scaling device downstream of the lateral transfer furnace.

BRIEF DESCRIPTION OF THE DRAWINGS

These and other characteristics of the present invention will become apparent from the following description of a preferential form of embodiment, given as a non-restrictive example with reference to the attached drawings wherein:

FIG. 6 shows a numerical example of sizing that uses the diagram in FIG. 5;

DETAILED DESCRIPTION OF A PREFERENTIAL FORM OF EMBODIMENT

Figure 1:
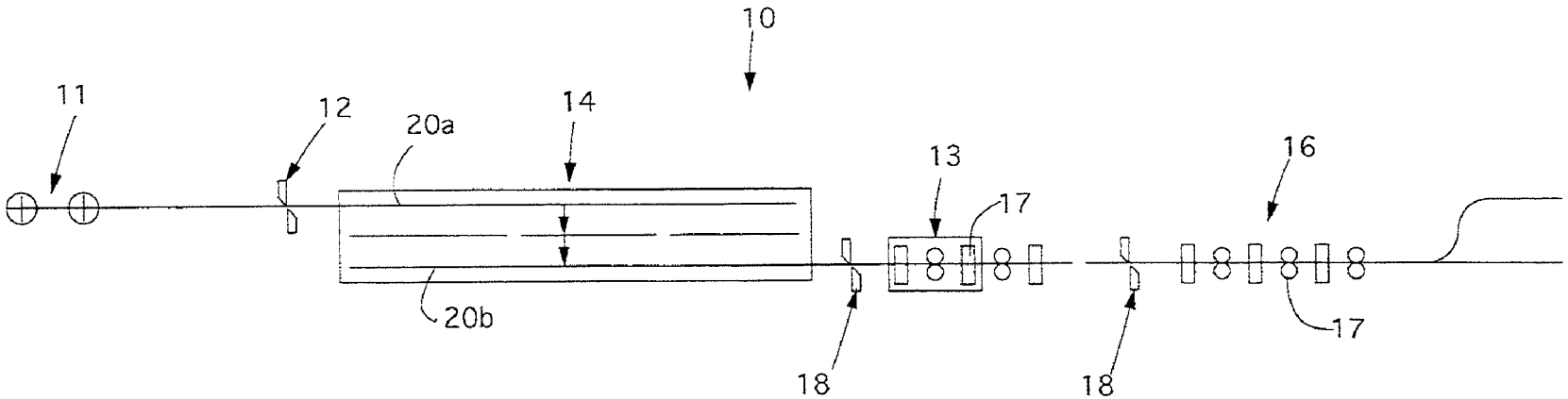
FIGS. 1-4 show four possible lay-outs of a rolling plant according to the present invention.

With reference to the attached drawings, FIG. 1 shows a first example of a lay-out 10 of a plant for the production of long rolled products according to the present invention.

Figure 12:
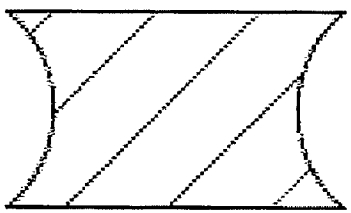
Figure 9:
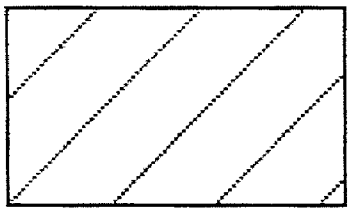
Figure 11:
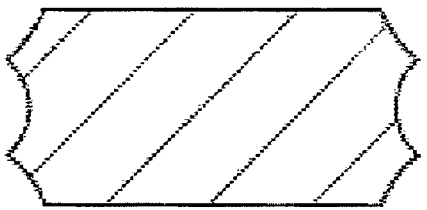

The lay-out 10 in FIG. 1 comprises, in the essential elements shown, a continuous casting machine 11 with one line only which uses a crystallizer or other device suitable to cast blooms of various shapes and sizes, mostly rectangular with straight, curved, concave or convex sides, or other. Some examples of sections that can be cast with the present invention are shown in FIGS. 9-12, which show respectively a rectangular section with straight and parallel sides (FIG. 9), a section with short sides with a convex curvature and straight and parallel long sides (FIG. 10), a section with short sides having a convex curvature at the center and with straight and parallel long sides (FIG. 11) and a section with short sides with a concave curvature and straight and parallel long sides (FIG. 12).

The continuous casting machine 11 is disposed on a line offset but parallel with respect to the rolling line defined by a rolling mill 16 located downstream. In this way a discontinuous or semi-endless process is achieved, but with a performance that, as will be seen, and thanks to the sizing of the parameters provided in the present invention, is very close to a process without solution of continuity or endless.

Advantageously, the continuous casting machine 11 is high-productivity, and can reach casting speeds comprised between 3 and 9 m/min, according to the type of product (section, quality of steel, final product to be obtained, etc.), and can also cast sections with a widened shape, that is, with one size prevailing over the other, in a ratio preferably comprised between 1.02 and 4.

In particular, the continuous casting machine 11 allows to obtain a productivity that varies from 35 ton/h to 200 ton/h.

Merely to give an example, the sections that can be cast can be chosen between 100 mm×140 mm, 100 mm×160 mm, 130 mm×180 mm, 130 mm×210 mm, 140 mm×190 mm, 160 mm×210 mm, 160 mm×280 mm, 180 mm×300, 200 mm×320 mm or intermediate sizes. In the case of the production of average profiles even bigger dimensional sections can be used, for example about 300 mm×400 mm and similar.

Advantageously sections of this type allow to obtain blooms with a high metric weight given the same section height, or thickness.

Downstream of the continuous casting machine 11 there are means for shearing to size 12, for example a shears or an oxy-cutting torch, which shear the cast blooms into segments of a desired length. Advantageously, the blooms are cut into segments of a length from 1 to 10 times more than that in the state of the art and, according to the present invention, is comprised between 16 and 150 meters, preferably between 16 and 80 m, more preferably between 40 and 60 meters. In this way blooms of a great weight are obtained, from 5 to 20 times higher than in the state of the art which, according to the present invention, is comprised between 10 and 100 ton.

In this way, although all the lay-outs 10, 110, 210, 310 are configured as operating in semi-endless mode, in that they start from segments sheared to size, blooms of great length and great linear weight allow, during normal working conditions, to operate in a condition of substantial continuity, obtaining a performance very close to that of the endless mode.

Figure 2:
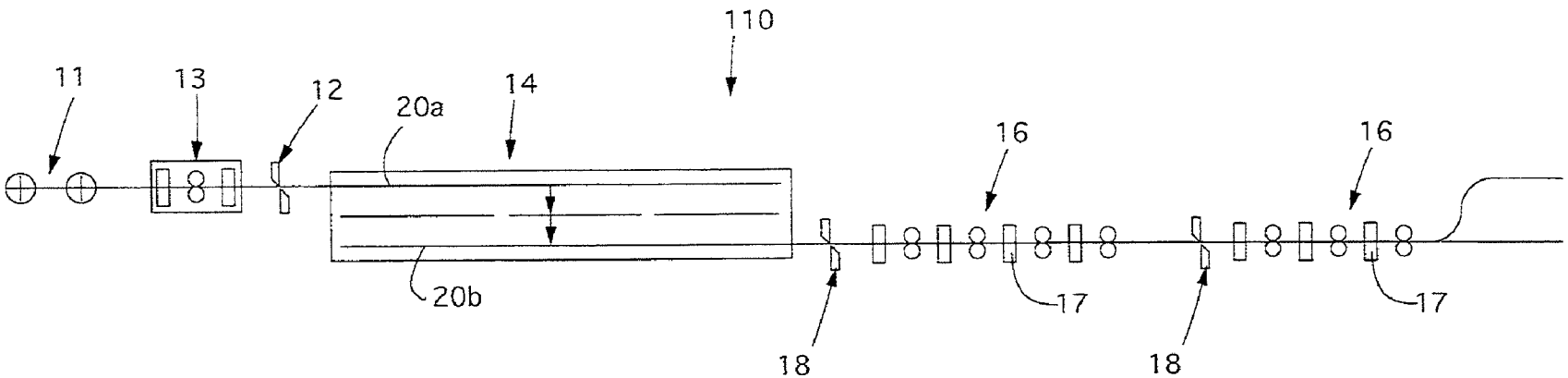
Figure 3:
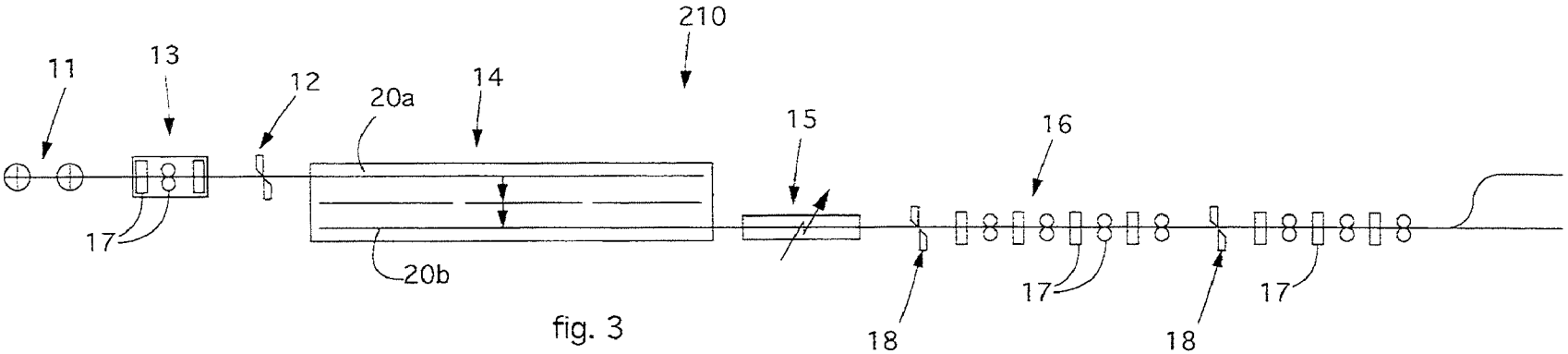

In the alternative lay-outs 110 and 210 in FIGS. 2 and 3, where the same reference numbers correspond to identical or equivalent components, there is an additional reduction/roughing unit 13, generally consisting of 1 to 4 stands and, in this case, three alternating vertical/horizontal/vertical rolling stands 17 or vertical/vertical/horizontal. In some case, it is possible to use only one vertical rolling stand. The stands 17 are used to return the cast section having a widened shape to a square, round, or oval section, or at least less widened than the starting section, in order to make it suitable for rolling in the rolling mill 16 located downstream. Even though in the drawings the number of stands is 3, it is understood that the number can be chosen from 1 to 4, according to the overall design parameters of the line and to the products to be continuously cast.

The best position for the additional reduction/roughing unit 13 along the line comprised from the end of casting to the beginning of the rolling mill 16 is established in relation to the speed obtainable at entrance to the first stand of the unit. For example, if the speed is comprised between 3 and 4.8 m/min (0.05 in/sec and 0.08 m/sec), the reduction/roughing unit 13 is positioned immediately downstream of the continuous casting machine 11 and upstream of the shearing to size means 12, whereas if the speed at entrance to the stand is greater, for example comprised between 5 and 9 m/min, the additional reduction/roughing unit 13 is put at the head of the rolling mill 16 and downstream of the heating and/or maintenance furnace 14, as we shall see hereafter.

Another parameter that can condition the choice of inserting the additional reduction/roughing unit 13 immediately downstream of the continuous casting machine and upstream of the shearing means 12 is the energy factor.

When the first reduction in section is performed immediately downstream of the continuous casting, immediately after the closing of the metallurgic cone, energy consumption is reduced since the reduction in section takes place on a product with a core that is still very hot, and therefore it is possible to use a lesser force of compression and to use smaller stands that require less power installed.

Downstream of the continuous casting machine a maintenance and/or possible heating furnace 14 is disposed, of the horizontal, lateral transfer type, which receives, along a first axis, the segments of bloom supplied by casting and sheared to size by the shearing means 12, and feeds them to the rolling mill 16 located downstream along a second axis, parallel to the first.

Advantageously, the fact that there is only one high-productivity casting line allows to feed directly the maintenance and/or possible heating furnace 14 at an average temperature of at least 1000° C., preferably comprised between about 1100° C. and about 1150° C. The average temperature at which the bloom leaves the furnace is instead comprised between about 1050° C. and 1180° C.

As can be seen in all the lay-outs in FIGS. 1-4, the rolling line is offset and parallel with respect to the casting line, and the maintenance and/or possible heating furnace 14 comprises a first movement section 20*a*, disposed in axis with the casting axis, and a second movement section 20*b*, disposed in axis with the rolling axis. Inside the maintenance and/or possible heating furnace 14 the necessary lateral connection is achieved, thanks to the presence of devices, not shown here, which transfer the segments of bloom from the movement section 20*a* to the movement section 20*b*, and also discharge the segments from the axis 20*b* so as to feed them to the rolling mill 16 located downstream.

The maintenance and/or possible heating furnace 14 not only creates the lateral connection between the two offset lines but also has at least the following functions and works with the following modes:

it functions as a chamber only to maintain the blooms at temperature. In this configuration the chamber guarantees that the temperature of the charge is maintained between entrance and exit;

it functions as a heating furnace for the blooms. In this configuration the furnace 14 raises the temperature of the load between entrance and exit, for example to restore the temperature lost when the additional reduction unit 13 is provided immediately downstream of casting.

The lateral transfer furnace 14, as we said, is divided into two sections, a first entrance movement section 20*a* that works with the rhythm of the continuous casting 11 located upstream, and a second exit movement section 20*b* that operates at the rhythm of the rolling mill 16 located downstream.

In particular, the movement sections 20*a* and 20*b* comprise respective internal rollerways, a first in axis with the rollerway of the continuous casting 11 and a second in axis with the rollerway that feeds the rolling mill 16. The two movement sections, or rollerways, 20*a*, 20*b* function in synchrony respectively with the continuous casting 11 and with the rolling mill 15, whereas the movement of the segments of bloom from one rollerway to the other is ensured, as we said, by the lateral transfer devices, not shown here, which introduce/remove the blooms.

The maintenance and/or possible heating furnace 14 also functions as a lateral transfer store which can compensate the different productivities of the continuous casting machine 11 and the rolling mill 16 located downstream.

Furthermore, if there is an interruption in the functioning of the mill, due to accidents or for a programmed roll-change or for change of production, the introduction devices continue to accumulate the blooms arriving until the internal buffer is full, whereas the removal devices remain still.

When the mill starts functioning again, the removal devices start their normal functioning cycle again, whereas the introduction devices again proceed to translate the blooms from the entrance rollerway to the exit rollerway.

As we said above, the maintenance and/or possible heating furnace 14 allows to carry out production changes, replacing some or all the stands of the rolling mill 16, offering the possibility of a buffer time of up to 60 minutes, without needing to stop the continuous casting machine.

The optimum length of the bloom can be chosen according to the reduction to a minimum of the linear combination of the heat losses in the maintenance and/or possible heating furnace 14 and the losses of material due to crops, short bars and blockages.

To give an example, the function is expressed according to the following formula:

$$F(E,Y)=ke\cdot E+ky\cdot Y;$$

where the term ke·E represents the economic loss caused by the energy consumption for maintaining and/or possibly heating the blooms, directly proportional to the length Lb of the bloom: E=fe*Lb (kwh/tproduced), while the term ky·Y represents the economic loss caused by crops, blockages and short bars in the rolling mill, inversely proportional to Lb: Y=fy/Lb(tscrap/tproduced).

In other words, the term ky·Y represents the inverse of the yield of the material.

Figure 5:
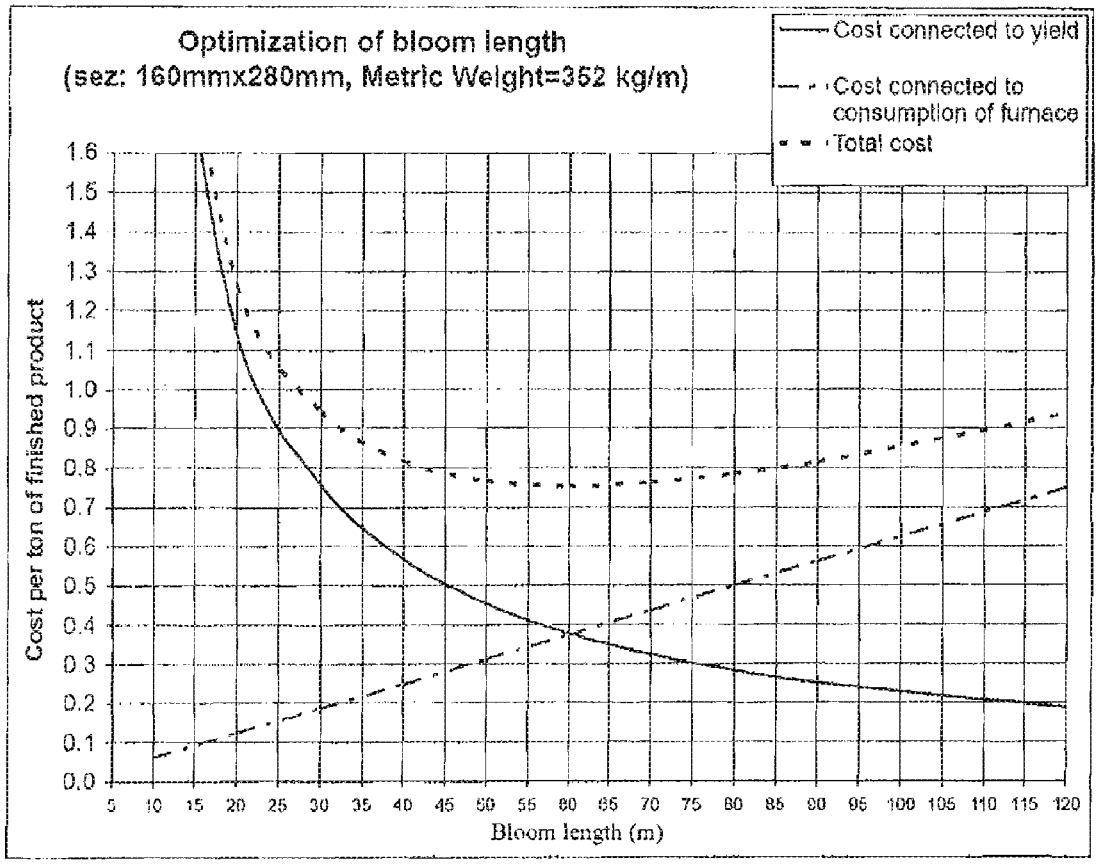
FIG. 5 shows a diagram for calculating the optimum length of the segment of bloom according to the present invention.

The graph in FIG. 5 shows the curves relating to the terms ke·E and ky·Y.

Developing:

$$F(E,Y)=ke*(fe*Lb)+ky*(fy/Lb)$$

whence, setting the first derivative at zero (dF/dL=0) we have:

$$ke*d(fe*L)/dL+ky*d(fy/L)/dL=0$$

with:

ke, ky conversion constants, fe, fy continuous functions connected to the particular plant and technological conformation.

In the particular case where (fe, fy) are constant functions, then:

$$L\text{optimum}=[(ky*fy)/(ke*fe)]^{0.5}$$

For example, in the case (shown as an example in the diagram in FIG. 5) of a bloom sized 160 mm×280 mm, weighing 352 kg/m, with a section equivalent to a square with a side of 211.66 mm, and determining the coefficients suitably in accordance with experiments carried out by Applicant, we obtain a minimum point of the function expressed above, corresponding to an optimum length of the bloom (Lott) equal to 60 m.

Since this optimum bloom length is calculated according to consumption parameters of the furnace 14 that are directly connected to its length, it is also valid for determining the optimum length of the furnace 14 itself. The lateral transfer furnace 14 will have an optimum length at least equal to that of the bloom, except that advantageously a safety margin is provided which takes into account possible blooms that have been cut out of tolerance, and also the necessary dimensional and constructional adjustments.

In this way, the optimum operating conditions are identified for the coordination of the continuous casting machine and the rolling mill.

The Table in FIG. 6 shows a comparison between a rolling plant for long products with a single casting line, working with the teachings of the invention, starting from a bloom with a section 160×280, and a state-of-the-art rolling plant using four casting lines associated with only one rolling mill and that works starting from a square product with a section 150×150.

As can be seen from the Table, the optimized length equal to 60 meters is considerably higher than the conventional lengths used, equal to 14 meters, and the weight of the bloom is also much greater.

The yield is much increased thanks to the reduced loss of material due to crops along the rolling mill 16 and due to the elimination of short bars.

Another parameter of particular relevance is the sharp reduction in the consumption of natural gas to feed the furnace 14, up to 50%, compared with traditional solutions.

Figure 7:
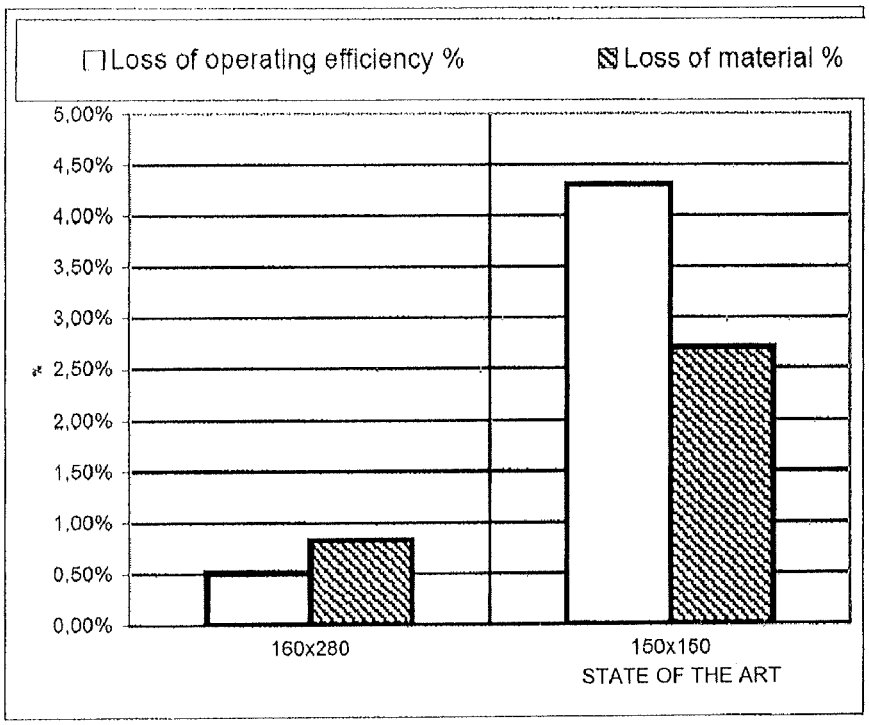
FIGS. 7 and 8 show respectively the savings in terms of operating efficiency and the consumption of natural gas of the solution according to the present invention and conventional solutions with multiple casting lines and bloom length less than 16 m.
Figure 8:
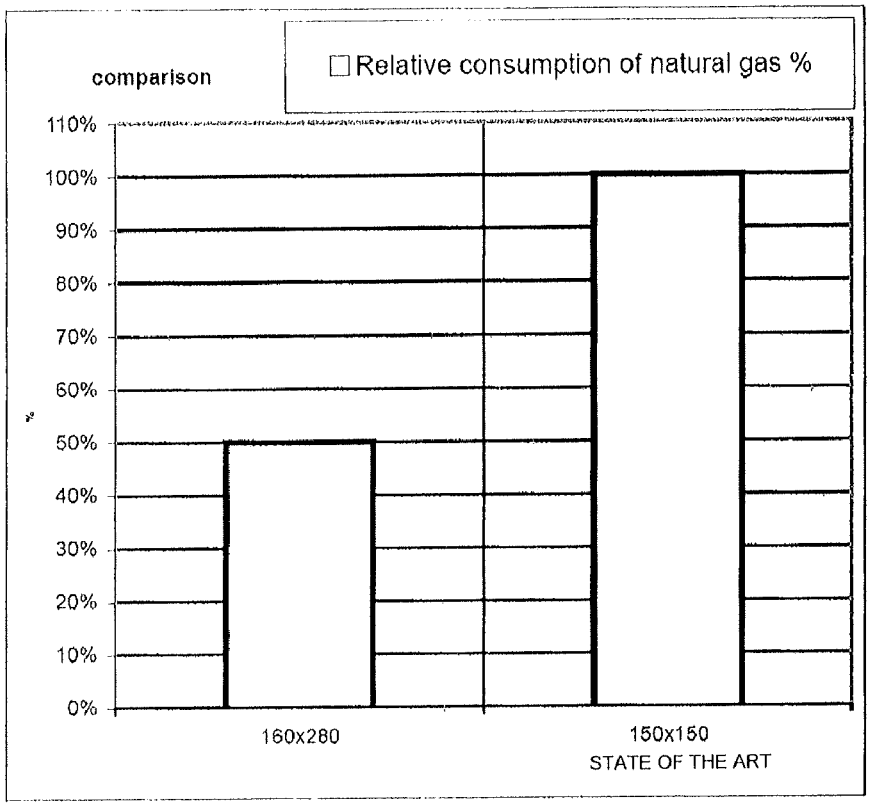
Figure 10:
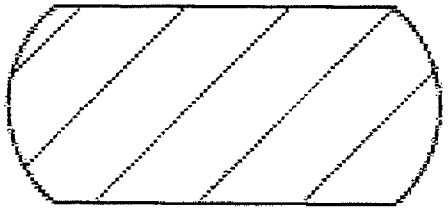
FIGS. 9-12 show examples of some different sections that can be cast with the plants in FIGS. 1-4.

The graphs in FIGS. 7 and 8 show respectively the savings in terms of operating efficiency and the consumption of natural gas of the solution according to the present invention (columns on the left) and conventional solutions with multiple casting lines and bloom length less than 16 m (column on the right).

Figure 4:
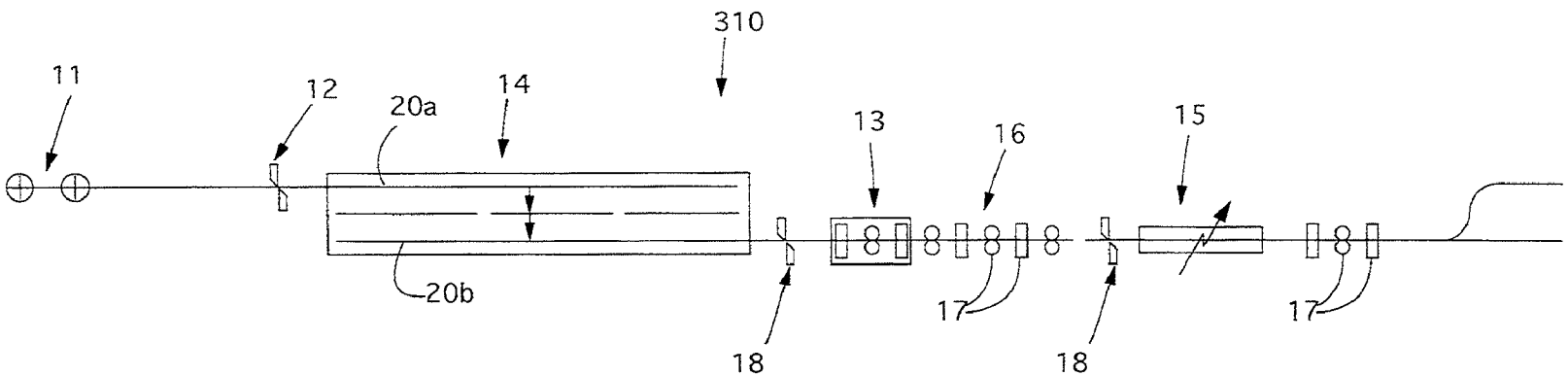

The lay-out 210 in FIG. 3 differs from those in FIGS. 1 and 2 in that it has an inductor 15 immediately at exit from the maintenance and/or possible heating furnace 14, whereas the lay-out in FIG. 4 differs from the others in that the inductor 15 is located in an intermediate position between the stands 17 of the rolling mill 16.

The inductor has the function of taking the temperature of the blooms to values suitable for rolling, at least if the temperature at which they leave the furnace is about 1050° C. or lower. For example, when the additional reduction unit is provided immediately downstream of casting and the furnace 14 only performs maintenance, then the inductor at exit from the furnace provides to restore the temperature lost in said additional reduction unit.

The number of rolling stands 17 used in the mill 16 varies from 3-4 to 15-18 and more, depending on the type of final product to be obtained, the thickness of the cast product, the casting speed and still other parameters.

Upstream of the rolling mill 16, or in an intermediate position thereto, there may be cropping shears, emergency shears, scrapping shears, all identified generally with the reference number 18. Other components known in the state of the art, such as de-scalers, measurers, etc., not shown, are normally present along the lay-out 10, 110, 210, 310 present in the attached drawings.

The invention claimed is:

1. A method to make long metal rolled products, comprising the following steps:

continuous casting at high hourly productivity, from 35 t/h to 200 t/h, done by a single casting machine, defining a casting axis, of a cast product with a rectangular section, wherein the rectangular section has a ratio of a larger side to a smaller side which is higher than or equal to 1.02 to less than or equal to 4;

shearing to size of the cast product to define a segment of a length comprised between 16 and 150 m and with a weight comprised between 10 and 100 tons;

introduction of the segment, having an average temperature of at least 1000° C., into a maintenance and/or heating furnace, comprising a first movement section for moving the cast product disposed in axis with said casting axis;

lateral transfer of the segment inside the maintenance and/or heating furnace transferring the segment to a second movement section for moving the cast product disposed parallel and misaligned with respect to the first movement section and aligned with a rolling axis parallel and offset with respect to the casting axis;

reduction/roughing of the rectangular section of the cast product in a reduction unit positioned upstream or downstream of said maintenance and/or heating furnace correlating to a speed of entrance by the cast product at an entrance of a first stand of the reduction unit, wherein the reduction/roughing transforms the rectangular section into a squared, round or oval section for a subsequent rolling step; and reduction of the section in a rolling mill defining said rolling axis.

2. The method as in claim 1, wherein the length of said segment sheared to size, to which the length of the maintenance and/or heating furnace is correlated, is calculated according to the reduction to a minimum of a linear combination of heating losses in the maintenance and/or heating furnace and losses of material, using the following formula:

$$F(E,Y)=ke\cdot E+ky\cdot Y;$$

wherein ke·E represents economic loss caused by the energy consumption of the furnace, and ky·Y represents economic loss caused by the losses of material due to shearing of leading and tail ends leading to crops, cobbles and short bars in the rolling mill.

3. The method as in claim 1, wherein said continuous casting machine operates at a casting speed of 3 to 9 m/min.

4. The method as in claim 1, wherein the squared section of the cast product has a surface having equivalent sides from 100 to 300 mm.

5. The method as in claim 1, wherein said reduction/roughing is provided upstream of the maintenance and/or heating furnace, and the speed of entrance into the first stand is about 0.05 m/sec to about 0.08 m/sec.

6. The method as in claim 1, the method providing a rapid heating step carried out by an inductor placed immediately at an exit from the maintenance and/or heating furnace, and/or in an intermediate position between stands of the rolling mill.

7. The method as in claim 1, wherein said reduction/roughing is provided downstream of the maintenance and/or heating furnace, and the speed of entrance into the first stand is about 0.08 m/sec to about 0.1 m/sec.

* * * * *